US008985341B2

(12) United States Patent
Lapeyre et al.

(10) Patent No.: US 8,985,341 B2
(45) Date of Patent: Mar. 24, 2015

(54) SYSTEM AND METHOD FOR GRADING ARTICLES AND SELECTIVELY MIXING GRADED ARTICLES

(75) Inventors: Robert S. Lapeyre, New Orleans, LA (US); Christopher G. Greve, Covington, LA (US)

(73) Assignee: Laitram, L.L.C., Harahan, LA (US)

( * ) Notice: Subject to any disclaimer, the term of this patent is extended or adjusted under 35 U.S.C. 154(b) by 0 days.

(21) Appl. No.: 13/981,760

(22) PCT Filed: Feb. 2, 2012

(86) PCT No.: PCT/US2012/023582

§ 371 (c)(1),
(2), (4) Date: Jul. 25, 2013

(87) PCT Pub. No.: WO2012/106494

PCT Pub. Date: Aug. 9, 2012

(65) Prior Publication Data

US 2013/0313169 A1 Nov. 28, 2013

Related U.S. Application Data

(60) Provisional application No. 61/438,837, filed on Feb. 2, 2011.

(51) Int. Cl.
*B07C 5/00* (2006.01)
*B07C 5/38* (2006.01)

(52) U.S. Cl.
CPC .... *B07C 5/00* (2013.01); *B07C 5/38* (2013.01)
USPC ..... 209/546; 209/659; 209/660; 209/661; 209/662

(58) Field of Classification Search
USPC ..... 209/546, 606, 659, 660, 661, 662
See application file for complete search history.

(56) References Cited

U.S. PATENT DOCUMENTS

| | | | | |
|---|---|---|---|---|
| 5,903,341 | A * | 5/1999 | Perry et al. | 356/237.1 |
| 5,998,754 | A * | 12/1999 | Pervieux | 209/587 |
| 2005/0004824 | A1 * | 1/2005 | Sheffler et al. | 705/7 |
| 2009/0216368 | A1 * | 8/2009 | Thorsson | 700/219 |
| 2012/0193272 | A1 | 8/2012 | Greve et al. | |

FOREIGN PATENT DOCUMENTS

| | | | | |
|---|---|---|---|---|
| WO | 9420230 | A1 | 9/1994 | |
| WO | 2010097684 | A2 | 9/2010 | |
| WO | WO 2010097684 | A2 * | 9/2010 | B65B 35/36 |

OTHER PUBLICATIONS

International Search Report and Written Opinion of the International Searching Authority, PCT/US2012/023582, mailed May 25, 2012, USPTO, Alexandria, Virginia.
"Fish Grading Machines KM.231 & KM.232," data sheet, K.M. Fish Machinery, A/S, Dybvad, DK.

(Continued)

*Primary Examiner* — Terrell Matthews
(74) *Attorney, Agent, or Firm* — James T. Cronvich

(57) ABSTRACT

Apparatus and methods for grading products and forming predetermined mixes of graded products. Graders sort products into different grades. The graded products are formed into batches of known quantity. Each batch is designated for deposit in a bin specified to have a certain mixture of graded products. A conveyor conveys the batches to the designated bin. The quantity of each batch is determined by count or weight.

15 Claims, 7 Drawing Sheets

(56) References Cited

OTHER PUBLICATIONS

"Roller Grader" brochure, PATKOL Public Company Limited, Rachathewa, TH.

"Axial roller grader" data sheet, Cabinplant A/S, Haarby, DK.

"Onshore Seafood Processing" brochure on CT 1018, Carnitech A/S, Stovring, DK.

* cited by examiner

SYSTEM AND METHOD FOR GRADING ARTICLES AND SELECTIVELY MIXING GRADED ARTICLES

BACKGROUND

The invention relates generally to apparatus and methods for grading or sorting solid objects and more particularly to systems for mixing batches of graded objects to form selected mixtures of objects of various grades.

Graders are used to sort solid objects into different sizes, or grades. Solid objects that are graded include food products, such as fruits, vegetables, nuts, shellfish, portions of meat, poultry, and fish, and non-food products, such as ball bearings, castings, and aggregates. Graders are typically operated with the products in each grade permanently separated by grade for subsequent handling. In some instances, however, it is necessary to combine grades or even different products into specific mixes of products. For example, customers for chicken wings may require a mixture of 60% drummettes and 40% flats of certain grades. But forming and maintaining these specific mixtures is labor-intensive.

Thus, there is a need for efficiently forming specified mixtures of graded product.

SUMMARY

A method embodying features of the invention for forming mixtures of graded products comprises: (a) grading one or more products into a plurality of product grade zones; (b) accumulating predetermined quantities of graded products in each product grade zone; (c) forming individual batches of the predetermined quantities of graded products; (d) determining a destination for each of the individual batches from predetermined product mix settings; (e) conveying the individual batches to the destinations; and (f) forming mixtures of graded products by depositing the batches in destinations determined from the predetermined product mix settings.

In another aspect of the invention, a system embodying features of the invention for grading products comprises a first grader grading products into separate grades of products in individual grade zones and means for forming individual batches of predetermined quantity in each grade zone. A conveyor for advancing batches downstream and receives graded products in batches from means for delivering the separate batches onto the conveyor. Means for diverting the batches from the conveyor to selected destinations divert the batches to a plurality of destinations adjacent to the conveyor downstream of the first grader.

Another version of a grading system comprises a grader grading products into separate grades of products in individual grade zones. A sensor system produces sensor signals for determining the quantity of products in the individual grade zones. A controller coupled to the sensor system determines the quantity of products graded in each individual grade zone from the sensor signals.

BRIEF DESCRIPTION OF THE DRAWINGS

These features and aspects of the invention, as well as its advantages, are better understood by referring to the following description, appended claims, and accompanying drawings, in which:

DETAILED DESCRIPTION

Figure 1:
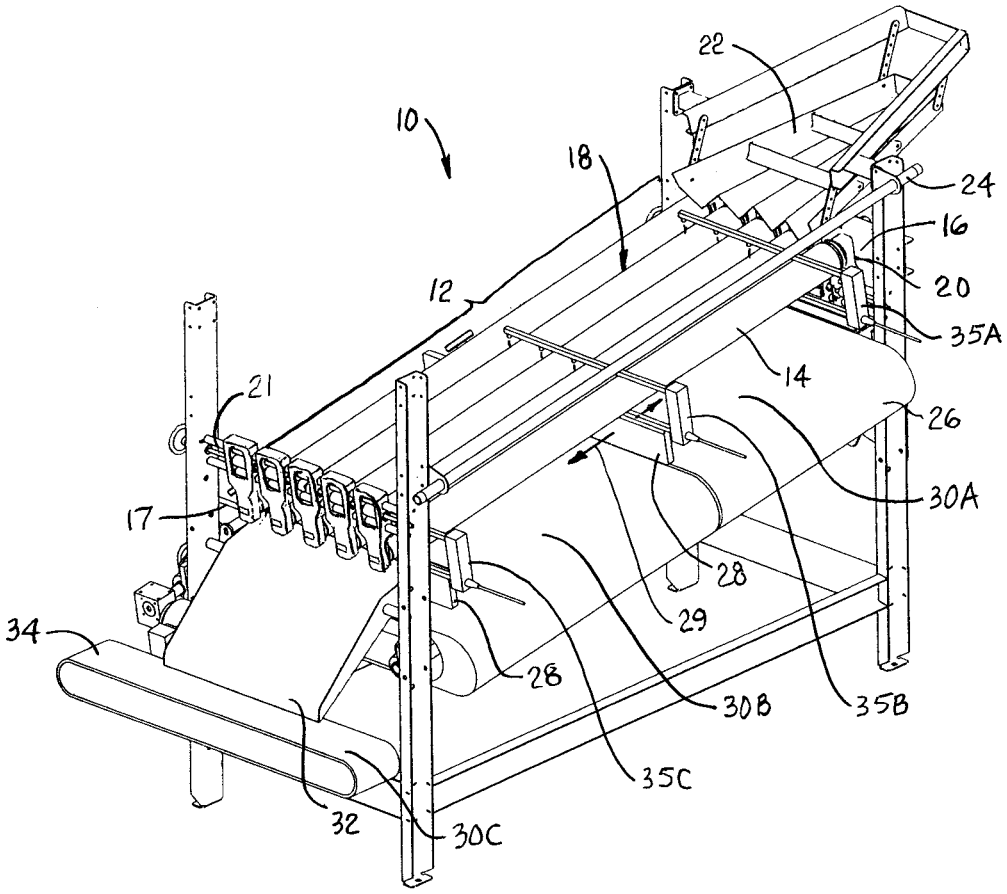
FIG. 1 is an isometric view of a grader usable in a grade-mixing system embodying features of the invention.

One version of a grader usable in a grading system embodying features of the invention is shown in FIG. 1. The grader 10 includes a grading section 12 comprising five constant-diameter rollers 14 arrayed in a planar array, shown here as inclined from a higher infeed end 16 to a lower exit end 17. The rollers are separated by four grading gaps 18 that widen from the infeed end to the exit end to form gauging passages for grading products. The widening gaps are formed by parallel tapered or stepped-diameter rollers or by diverging constant-diameter rollers, such as those illustrated in FIG. 1. The ends of the rollers may be fixed in lateral position to define permanent gap widths or may be rotationally and pivotally retained in gap-adjustment mechanisms 20, 21 at each end that allow the grading-gap widths at the infeed and exit ends to be adjusted to fine-tune the grading process. The gap-adjustment mechanisms 20, 21 may be controlled manually or automatically and may include an analog display providing a visual indication of the grading-gap width or a sensor providing a signal indicative of the gap width.

Products to be graded are introduced into a reciprocating or vibrating feed trough 22 that drops the products onto the grading section 12 at the infeed end 16. The rollers 14 all rotate in the same direction. A fluid spray directed from nozzles in a water pipe 24 lubricates the rollers and helps products slide down the declining grading section in the gaps. When the width of the gap matches the dimension of the product, the product falls through the gap to a bin or a conveyor, such as conveyor belt 26, below. Dividers 28 divide the conveyor 26 into separate grade zones 30A, 30B. The positions of the dividers 28 may be set manually by an operator or automatically by a linear actuator as indicated by arrow 29. Small products fall into the upstream zone 30A, and larger products fall into the downstream zone 30B. The largest products, which are too large to fall through the gap at the exit end 17 of the grading section 12 slide down a chute 32 onto a conveyor belt 34 in a third grade zone 30C. Thus, the grader shown in FIG. 1 grades products into three sizes, which can be conveyed laterally away from the grader by conveyor belts.

Figure 2:
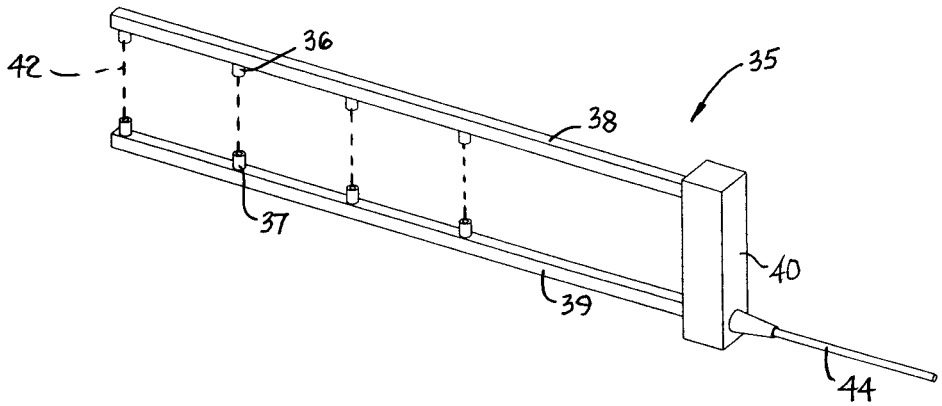
FIG. 2 is an isometric view of an optical counter used in the grader of FIG. 1.

The grader 10 of FIG. 1 also comprises a sensor system including arrays 35 of optical sensors, each including an emitter 36 and a corresponding detector 37 mounted on cantilevered arms 38, 39, as also shown in FIG. 2. The cantilevered arms 38, 39 extend from a support 40 with the upper arm 38 above the grading rollers 14 and the lower arm 39 below. The emitters emit light beams 42 that are aligned with each of the gaps 18 across the width of the grader. A product passing along the grading section beneath an emitter 36 interrupts the light beam. The signal from the detector 37 indicates the state of the light beam. When the light beam is interrupted, the state of the detector signal changes. Once the product passes the emitter-detector pair, the light beam's path is unblocked and the detector's signal changes state. The signal is routed to a controller (82, FIG. 8) via signal wires 44 connected to the support. By counting the changes of state of the signal from unblocked to blocked, the controller can count the number of products advancing along each grading gap in the grading section. The optical-sensor array 35A at the infeed end is used as a counter to count the total number of ungraded products. Another optical-sensor array 35B is positioned between grade zones 30A and 30B to establish the count of the number of products that are advancing to zones 30B and 30C. The number of the smallest products falling into zone 30A is the difference between the accumulated counts of arrays 35A and 35B. A third optical-sensor array 35C at the exit end is used as an optical counter to count the number of the largest-size products falling into the final grade zone 30C. The number of the products in grade zone 30B is determined by the difference in the count of the sensor array 35B and the sensor array 35C at the exit end.

Figure 3:
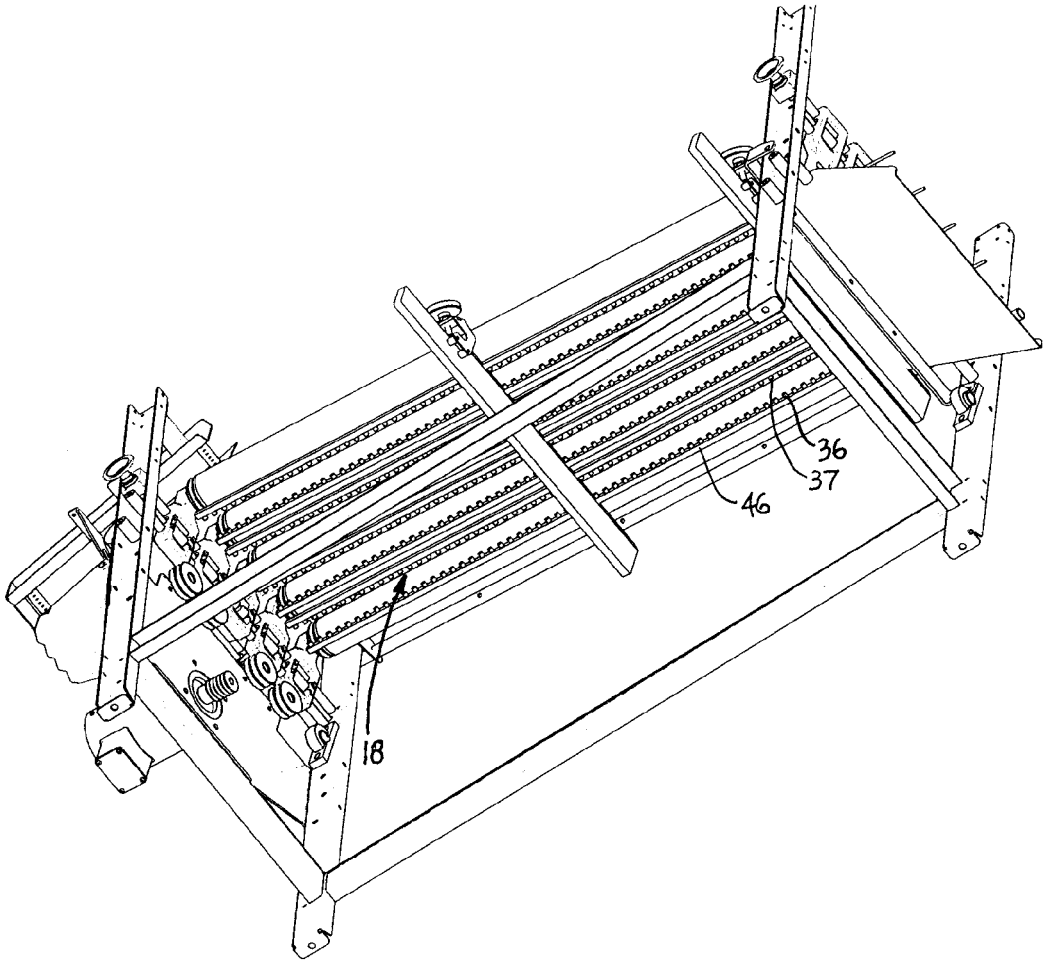
FIG. 3 is a bottom view of a grader as in FIG. 1 with a different version of optical counter.

An alternative arrangement of optical sensors used as counters is shown in FIG. 3. In this version, an elongated optical array 46 of many pairs of emitters 36 and detectors 37 flank the drop path of the products just below the grading gaps 18. As products drop through the grading gaps, they interrupt a single light beam or two or more consecutive beams. By processing the changes of states of the detector signals, the controller can determine the number of products falling into each grade zone.

Figure 4:
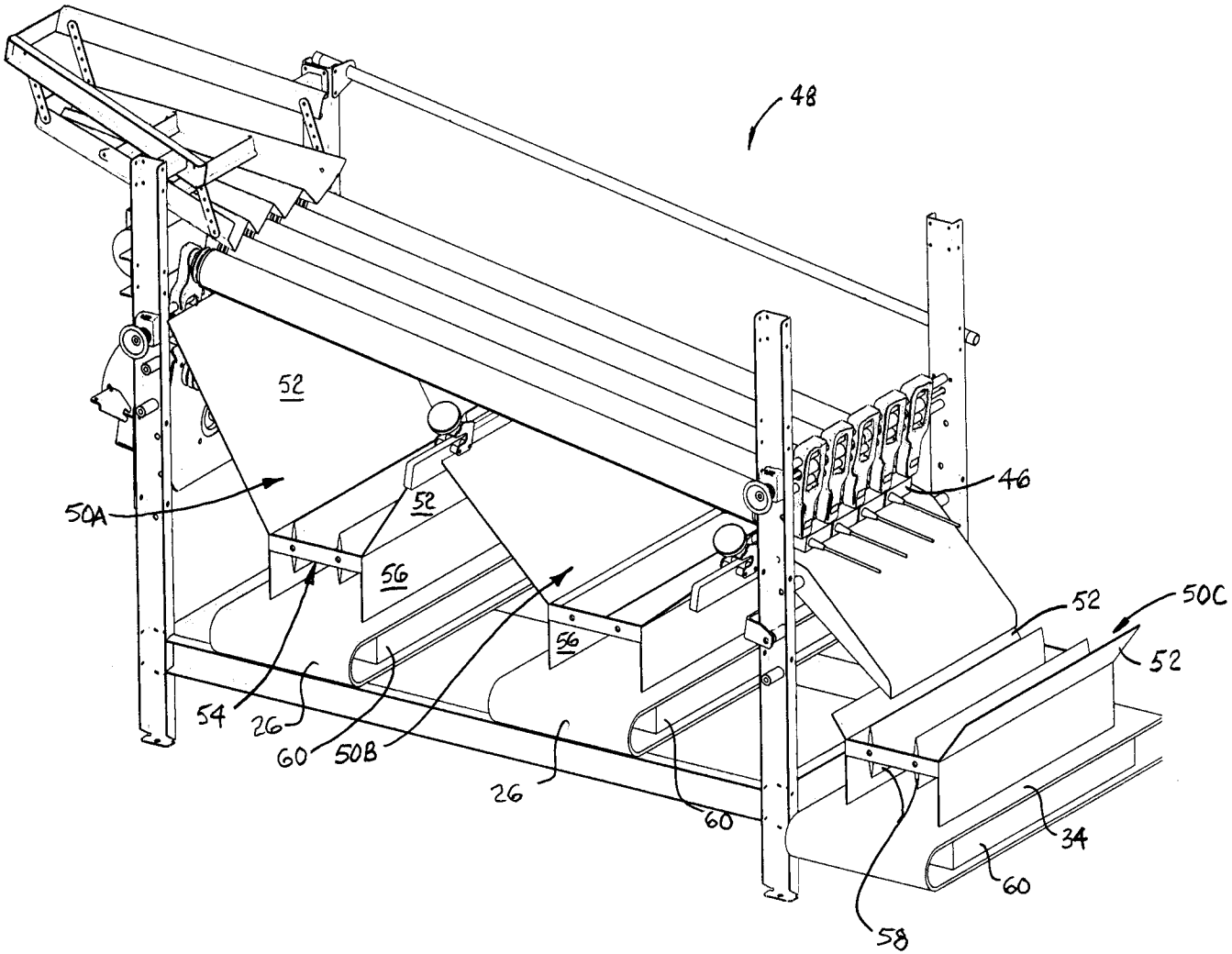
FIG. 4 is an isometric view of a grader as in FIG. 3 with a buffer for each grade zone and a batch-forming mechanism.

A different version of the grader of FIG. 1 is shown in FIG. 4. The grader 48 has the same array 46 of optical-sensor counters as in FIG. 3, but is also equipped with three buffers 50A, 50B, 50C corresponding to the three grade zones. Each buffer comprises a pair of angled walls 52 that funnel falling graded products through a restricted opening 54 bounded by a pair of side walls 56. Vanes 58 are rotated between an open position as shown for the buffers 50A and 50C and a closed position for the buffer 50B. In the open position, the long axis of each vane's cross section is vertical, which allows product to fall through the openings 54 and onto the conveyor belts 26, 34. When the vanes are closed, the long axis of each vane's cross section is horizontal and forms a floor atop which falling products accumulate. The controller controls the opening and closing of the vanes to form batches of predetermined quantities on the stationary conveyor in each zone. For example, the vanes in the zone could be closed whenever the count of graded product in that zone accumulates to a predetermined count since the previous batch. Once the vanes are closed, the next batch starts to accumulate in the buffer until the controller starts up the conveyor belt to move the completed batch away. Then the vanes open to drop the accumulated batch and to let subsequently graded products fall to the conveyor belt below. In these examples, the quantity of each batch was determined by head count. As one alternative, the quantity can be determined by weight. Instead of using optical sensors as counters, the grader has a scale 60 or some form of weight sensor beneath the conveying surfaces of the belts 26, 34 as a sensor system. A signal corresponding to the weight of product accumulated on the belt in each zone is routed to the controller, which closes the vanes 58 when the batch reaches the predetermined weight, and starts up the belt to convey the batch away from the grader. An impact sensor consisting of a platform mounted on load cells and positioned to support the conveying surface of each belt under the buffers could sense impacts to count or weigh product. By integrating the outputs of the load cells, the controller can determine the accumulated weight of graded product in each zone. Alternatively, by measuring the amplitudes of the impacts of falling products from the load-cell output signals, the controller can determine the number of graded products landing simultaneously on the belt. By counting the number of total impacts and incrementing the count appropriately for higher-amplitude impacts caused by simultaneous impacts, the controller can determine the product count and set the batch size.

Figure 5:
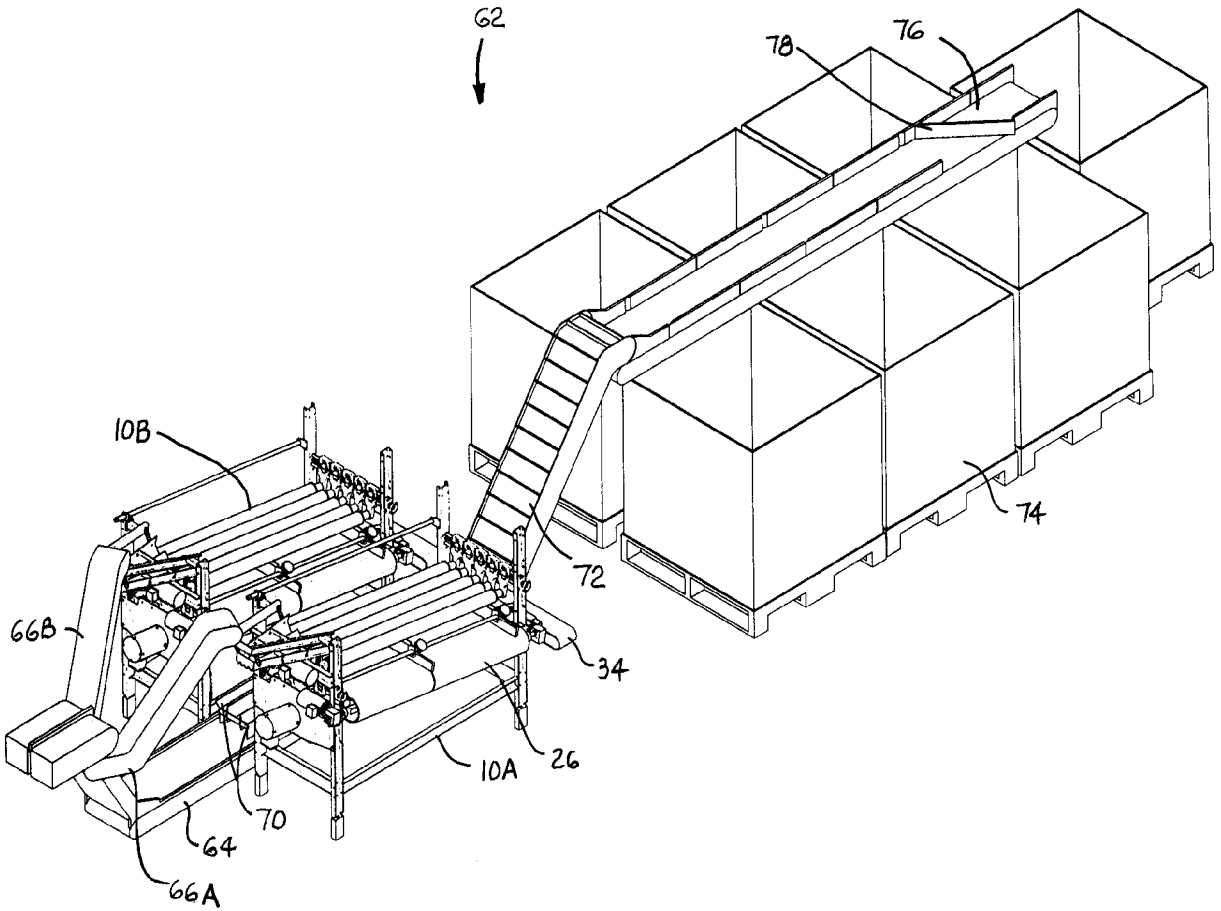
FIG. 5 is an isometric view of a grade-mixing system including two graders as in FIG. 1.
Figure 6:
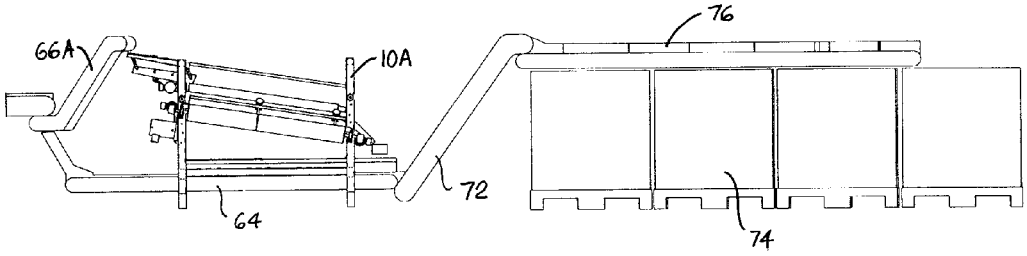
FIG. 6 is a side elevation view of the mixing system of FIG. 5.
Figure 7:
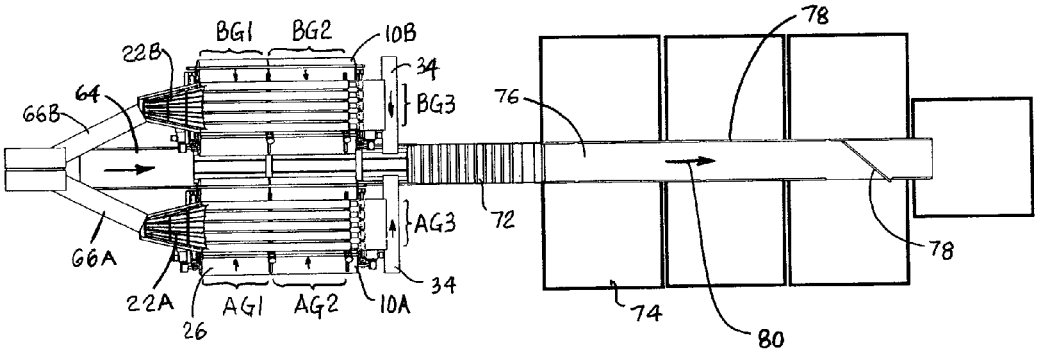
FIG. 7 is a top plan view of the mixing system of FIG. 5.

A mixing system using a grader as in FIGS. 1-4 is shown in FIGS. 5-7. The mixing system 62 includes two graders 10A, 10B flanking a trunk conveyor 64. In this example, each of the graders grades a different product: the grader 10A grades chicken drummettes, and the grader 10B grades chicken wing flats. The drummettes and flats are delivered by elevators 66A, 66B to infeed troughs 22A, 22B of the graders 10A, 10B. Each of the graders in this example is set to grade the product into three grades in three zones (from smallest to largest grade): AG1, AG2, AG3 (for the drummettes grader 10A); and BG1, BG2, BG3 (for the flats grader 10B). Conveyor belts 26, 34 convey the graded products to the trunk conveyor 64. Guides 70 above the trunk conveyor 64 funnel the graded products dropping from the belts into the middle of the trunk conveyor. Graded products exiting the trunk conveyor 64 are fed onto a flighted, inclined conveyor 72, which lifts the graded products up to the level of the tops of open bins 74. The inclined conveyor 72 dumps the graded products onto a sorting conveyor 76, which diverts the graded products to specified bins with gates 78 that pivot to a position traversing the sorting conveyor and guide conveyed products off the side and into a selected bin 74. The gates 78 pivot to a position parallel to the conveying direction 80 along the side of the sorting conveyor to allow products destined for a downstream bin to pass without diversion. Products allowed to pass all the bins flanking the sorting conveyor drop into a bin at the end of the sorting conveyor. Thus, the graded products can be conveyed to seven bins 74 in this example.

The two graders 10A, 10B include means for forming batches of a predetermined quantity for each of the six graders through the use of buffers and weight sensing or product count. The conveyor belts 26, 34 are operated stop-and-go as indexing belts to deliver individual batches of graded products onto the trunk conveyor 64, which can continuously advance the batches toward the bins.

Figure 8:
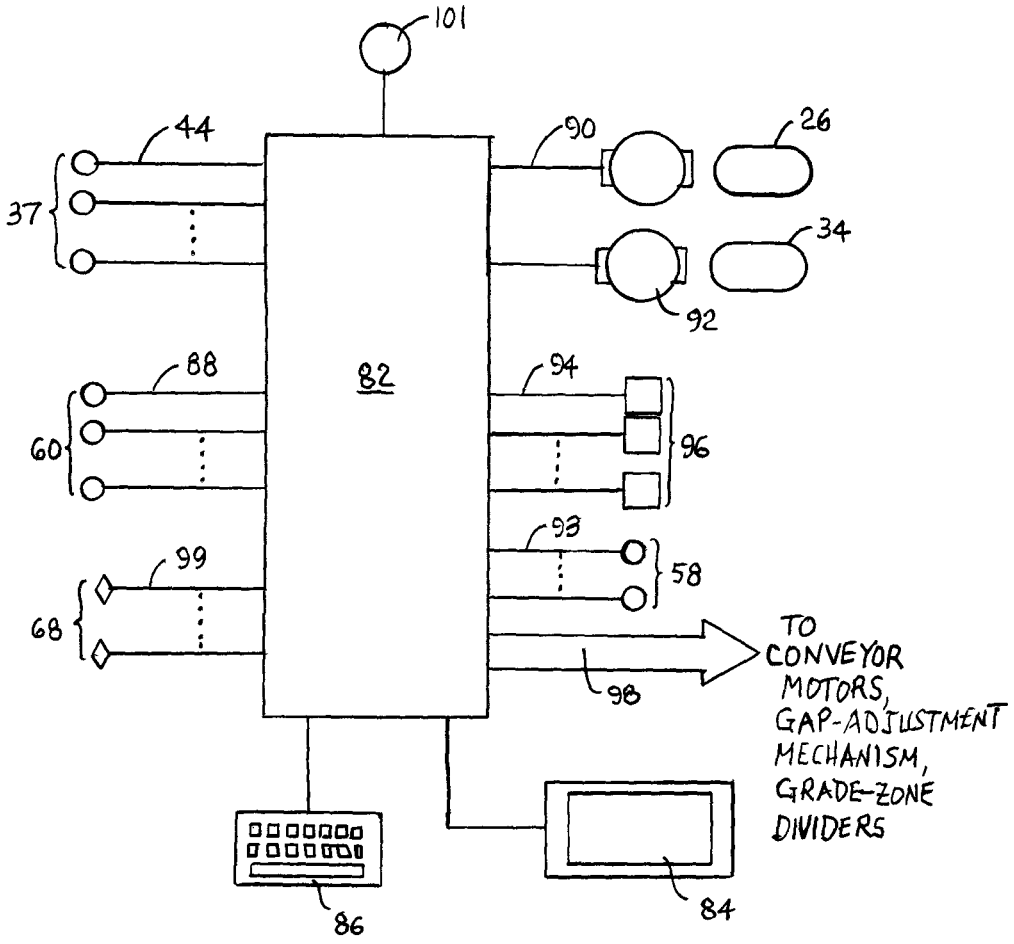
FIG. 8 is a block diagram of a control system in the mixing system of FIG. 5.

The operation of the system is controlled by the controller 82, as shown in FIG. 8. The controller may be a programmable-logic controller, a personal computer or workstation, or any appropriate programmable device. An operator interface comprising a monitor 84 and an input device, such as a keyboard 86, allows system settings to be made and the status to be monitored. The controller receives the count signals from all the counters 37 over the optical signal lines 44 or all the weight signals 88 from the scales 60. The controller 82 controls the starting and stopping of the graders' indexing conveyor belts 26, 34 over motor-control lines 90 connected to the belts' drive motors 92 and provides open-close batching signals over vane-control lines 93 to actuators for the buffer vanes 58. The controller also sends open-close signals 94 to gate actuators 96 that pivot the gates 78 between diverting and passing positions on the sorting conveyor. The controller may control the grading-gap widths, the positions of the grade-zone dividers, or the speed of the trunk conveyor 64, the elevator 66, the inclined conveyor 72, and the sorting conveyor 76 over signal lines 98. The controller 82 can activate an alarm 101 or display alarm conditions on the monitor 84. Other sensors 68 sensing the presence of batches at various positions along the conveying system, the grading-gap widths, or the positions of the grade-zone dividers may also send signals to the controller over sensor-signal lines 99 to allow closed-loop control of the transport of batches through the grading system or of the grading-gap or grade-zone settings.

Figure 9:
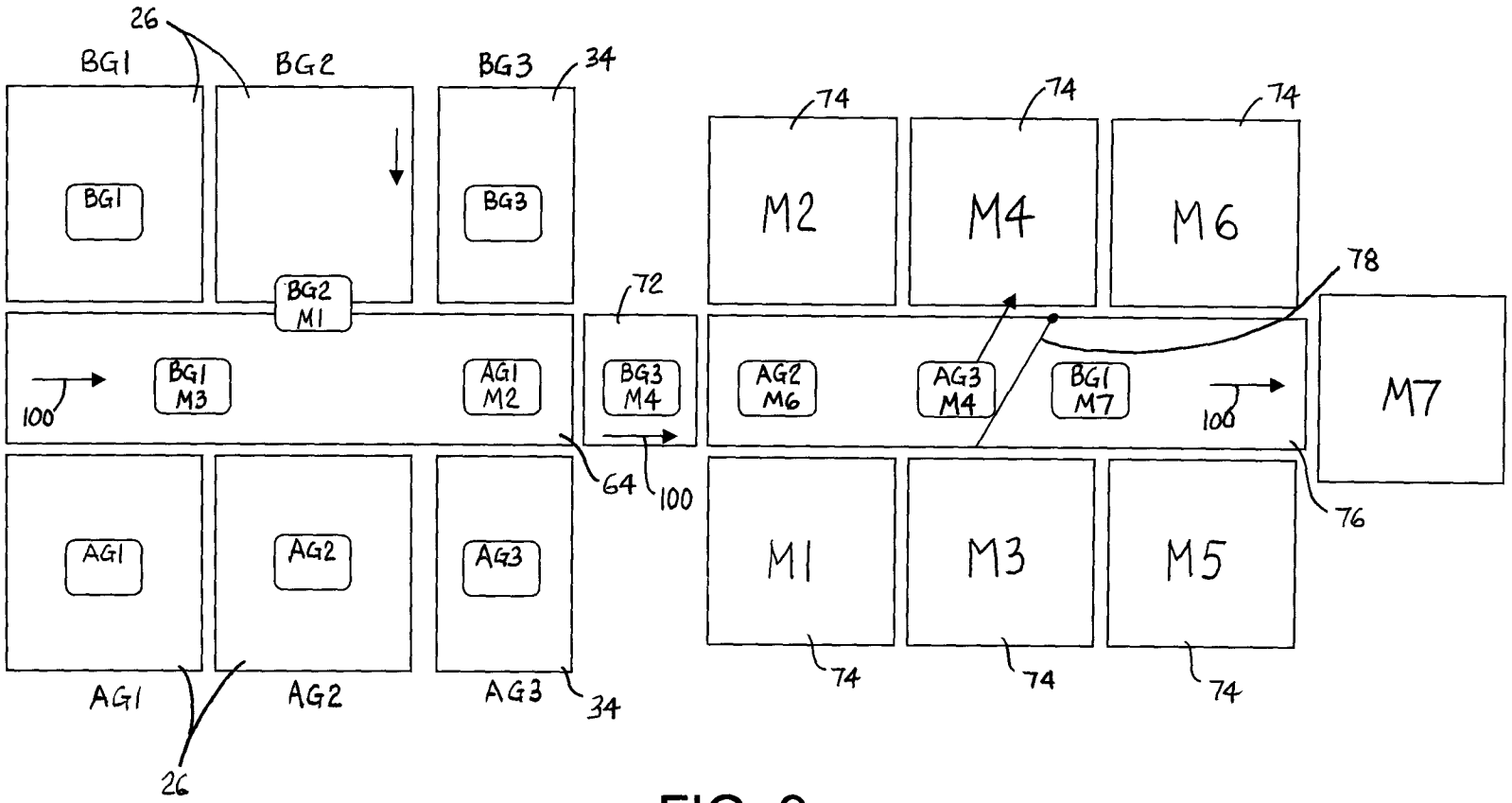
FIG. 9 depicts an example flow of batches of graded products in the mixing system of FIG. 5.

The operation of the grading and mixing system is illustrated in FIG. 9. In this example, the trunk conveyor 64, the incline conveyor 72, and the sorting conveyor 76 are all running at constant speeds in the directions of the arrows 100. The grader belts 26, 34 index batches of graded products of predetermined quantities onto the trunk conveyor from the sides. The grader belts are stopped while they are accumulating graded products. Once the quantity of the batch in each grade zone reaches the predetermined quantity for that batch, the controller closes the buffer and indexes the grader belt forward to load the batch destined for a specific mixing bin 74. For example, the batch in grade zone BG2 is denoted in FIG. 9 as BG2 M1 to indicate that it is a batch from grade zone BG2 destined for mixing bin M1. The controller 82 ensures that the batch is loaded onto an open area of the trunk conveyor 74. Because the controller knows the speeds of the conveyors and their geometries and the times that the grader belts loaded their batches onto the trunk conveyor, the controller can determine the positions of the batches on the trunk conveyor and can control the loading of batches onto the trunk conveyor to avoid collisions. Once the batch is loaded onto the trunk conveyor, the controller stops the indexing grader belt and re-opens the buffer to allow accumulated graded products to drop onto the belt. The batch is loaded onto the trunk belt and conveyed toward the mixing bins. Each batch has a known quantity (count or weight) of a certain grade of products and is associated with a known destination bin. For example, the bin M4 may require a mixture of 60% large-size drummettes and 40% large-size flats. The controller uses that predetermined mixture setting to set a quantity size for batches of drummettes in grade zone AG3 and a quantity size for batches of flats in grade zone BG3. The designated batches are formed and loaded onto the trunk conveyor. When one of the batches destined for the bin M4 reaches the bin, the controller pivots the bin's gate to divert the batch AG3 M4 (large-size drummettes) to bin M4. The gate is closed to allow the trailing batch AG2 M6, destined for downstream bin M6 to pass. Then M4's gate is re-opened to the diverting position to guide the BG3 M4 batch (large-size flats shown at an earlier time in FIG. 9 on the incline conveyor) to its destination bin M4. Because the controller knows the speeds of the conveyors and their lengths, it can keep a continuously updated map of the traffic on the conveyors. But, for more positive determination of the traffic status, optical sensors, cameras providing visual data, or proximity switches can be positioned along the conveying system to provide the controller with signals indicating the positions of the batches on the conveyors.

The controller allows each grade zone to provide batches of different quantities destined for different bins. Thus, the controller runs software processes that: (a) compute the quantities of each grade of products needed to form the selected product mixes; (b) form batches of the computed quantities in each grade zone; (c) load those batches onto the trunk conveyor; (d) assign destination bins to each batch; (e) manage and track traffic flow on the conveyors; and (f) divert the batches to their correct destinations. In this way, the controller automates the mixing of two different graded products into different product mixes.

The controller 82 may also provide useful data to operators or dynamically control the operation of grading. The data may be sensor data or data computed from the sensor data or operator settings. One example of useful data is the ratio of the product count to the weight of a batch of graded products. The controller can compute the ratio for each batch from the signals from the counters and the scales. If the ratio lies outside a preset range, the controller can set an alarm or can automatically adjust the gap widths or the positions of the grade-zone dividers. Another example of useful data is the count in each batch in corresponding zones of parallel conveyors within a time window. In grading chicken wings, in which all flats are conveyed to one grader and all drummettes are conveyed to a second grader, the number of drummettes in a grade zone should be more or less the same as the number of flats in the corresponding grade zone. And the gaps and dividers are set up that way. If the cutter that severs the wing tip from the flat is not cutting consistently at the joint, some of the flats will include a portion of a wing tip, which could cause the flat to be graded into too large a grade. So if the counts in corresponding zones from the first grader to the second are not incrementing at more or less the same average rates, an alarm can be sounded or the grader can be automatically adjusted. As another example, if a grader is set to produce batches at the same average rate in all the zones, but one zone is receiving more products than the other zones, the controller can sound an alarm or automatically take corrective action. Thus, the controller can be used to set alarms or automatically adjust grading settings when grading results lie outside alarm limits or set operating ranges. The controller can also display settings, setting ranges and alarm limits, conveyor speeds, batch weights and counts, batching rates, and other information on the monitor that can help operators fine tune the grading process. The controller can use the data it collects and computes to display time series of various grading results to show trends in the grading process that may indicate problems in the grading process. It should be clear that the data presentation, alarm setting, and control functions could be adapted for use with other kinds of graders that grade products into separate grades in individual grade zones.

Although the invention has been described with reference to a few specific versions, other versions are possible. For example, any kind of grader equipped with means for forming batches of each grade that contain a selected quantity of graded product could be used in the system. As another example, products could be counted by counters realized as series of limit switches having whisker actuators contacted by the products as they pass along the grading gaps at locations such as those where the optical sensors are located. A camera or other visioning system could also be used as a sensor system to count products falling into each grade zone or to identify the positions of batches on the conveyor. The mixing system may also be used with a single grader or with more than two graders. In the case of more than two graders, the trunk conveyor may have to be lengthened or a number of branch conveyors, each associated with a certain number of graders, may have to be used to feed into a trunk conveyor. And each of the graded batches may be transported to downstream graders if finer grading is required. Besides being useful in mixing batches of graded chicken wings, the grading and mixing system is adaptable to other food products, such as shrimp, fruits, vegetables, and nuts, and to non-food products, as well. So, as these few examples suggest, the scope of the invention is not meant to be limited to the details of the exemplary versions.

What is claimed is:

1. A system for grading products, comprising;

a grader grading products into separate grades of products in individual grade zones;

a sensor system for producing sensor signals for determining the quantity of products in the individual grade zones;

a controller coupled to the sensor system to determine the quantity of products graded in each individual grade zone from the sensor signals;

means for forming individual batches of predetermined quantities of products in each grade zone.

2. The system of claim 1 further comprising a buffer associated with each grade zone for buffering product being graded while a batch of graded products in the associated zone is being delivered to the conveyor.

3. The system of claim 1 wherein the sensor system comprises counters counting the products graded into each of the individual grade zones to determine the quantity of graded products.

4. The system of claim 1 wherein the sensor system comprises weight sensors weighing the products graded into each of the individual grade zones to determine the quantity of graded products.

5. The system of claim 1 wherein the sensor system comprises weight sensors and counters sending weight and count sensor signals to the controller, wherein the controller computes the ratio of the count and the weight of a batch of the graded products from the sensor signals and compares the ratio to a predetermined range of ratios.

6. The system of claim 1 wherein the controller computes operating conditions from the sensor signals, compares the operating conditions to predetermined alarm limits, and activates an alarm when the operating conditions are outside the alarm limits.

7. The system of claim 1 wherein the controller continuously computes operating conditions from the sensor signals to produce time series of the operating conditions for showing trends in the operating conditions.

8. The system of claim 1 further comprising a gap-adjustment mechanism to set the width of grading gaps of the grader and wherein the controller sends a control signal to the gap-adjustment mechanism to set the width of the grading gaps.

9. The system of claim 1 further comprising a zone divider between consecutive grade zones and wherein the controller sends a control signal to adjust the position of the zone divider along the grader.

10. The system of claim 1 further comprising a second grader grading products into separate grades of products in individual grade zones, wherein the controller computes operating conditions of both graders from the sensor signals of both sensor systems and compares the operating conditions of the graders to each other.

11. The system of claim 10 further comprising;

means for forming individual batches of predetermined quantity in each grade zone of the second grader;

a conveyor for advancing batches downstream;

means for delivering the separate batches onto the conveyor;

a plurality of destinations adjacent to the conveyor downstream of the graders;

means for diverting the batches from the conveyor to selected destinations.

12. The system of claim 11 wherein the means for forming individual batches includes a counter for counting the graded products in each batch.

13. The system of claim 11 wherein the means for forming individual batches includes a weight sensor for weighing the graded products in each batch.

14. The system of claim 11 wherein the means for diverting the batches includes diverting gates for selectively diverting the batches from the conveyor to their selected destinations.

15. The system of claim 11 wherein the means for delivering the separate batches onto the conveyor comprises conveyor belts in the grade zones, each arranged to stop to receive a batch being formed and to advance toward the conveyor when a batch is completely formed to deliver the batch to the conveyor.

* * * * *